United States Patent [19]

Yanagawa et al.

[11] 4,451,139

[45] May 29, 1984

[54] CLEANING APPARATUS FOR PHOTOCONDUCTIVE ELEMENT

[75] Inventors: Nobuyuki Yanagawa; Shinichi Kamiyama, both of Tokyo, Japan

[73] Assignee: Ricoh Company, Ltd., Tokyo, Japan

[21] Appl. No.: 410,733

[22] Filed: Aug. 23, 1982

[30] Foreign Application Priority Data

Sep. 4, 1981 [JP] Japan ..... 56-139425

[51] Int. Cl.[3] ..... G03G 15/08

[52] U.S. Cl. ..... 355/15; 355/3 DD; 430/125; 118/652; 15/256.52

[58] Field of Search ..... 355/15, 3 DD, 14 D; 118/652; 430/125; 15/256.51, 256.52

[56] References Cited

U.S. PATENT DOCUMENTS

| | | | |
|---|---|---|---|
| 3,848,992 | 11/1974 | Smith | 355/15 |
| 3,989,372 | 11/1976 | Davidge et al. | 355/15 |
| 4,111,545 | 9/1978 | Meltzer | 355/15 |
| 4,329,044 | 5/1982 | Kitajima et al. | 355/15 |
| 4,339,196 | 7/1982 | Beck et al. | 355/3 DD |

*Primary Examiner*—A. C. Prescott
*Assistant Examiner*—99
*Attorney, Agent, or Firm*—David G. Alexander

[57] ABSTRACT

A cleaning apparatus for a photoconductive element includes a cleaning member engaged with the surface of the photoconductive element to remove residual toner therefrom, a toner collecting member for collecting the toner removed by the cleaning member, and a casing for accommodating such members thereinside. The casing is formed with a guide section which permits the cleaning apparatus to be bodily moved in a direction perpendicular to an intended direction of movement of the photoconductive element. The guide section is positioned above the center of gravity position of the casing and farther from the photoconductive element than the center of gravity position. With this arrangement, the casing can be loaded and unloaded without any damage to the photoconductive element.

7 Claims, 2 Drawing Figures

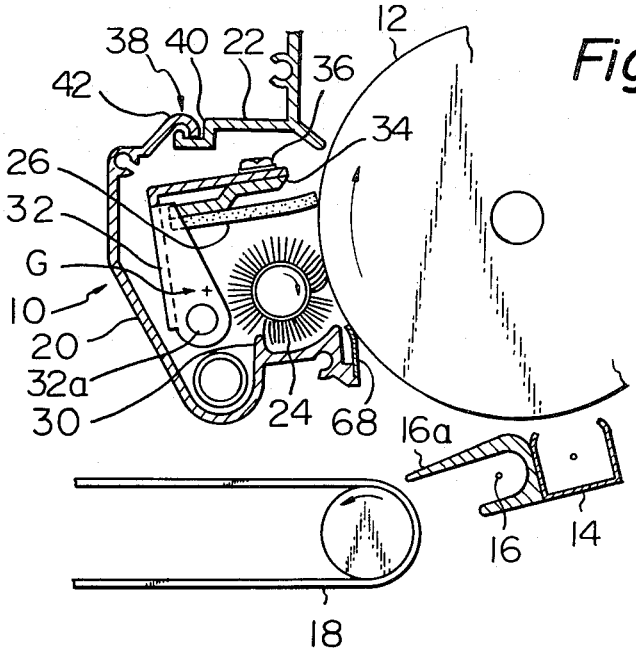
Fig. 1
Fig. 2
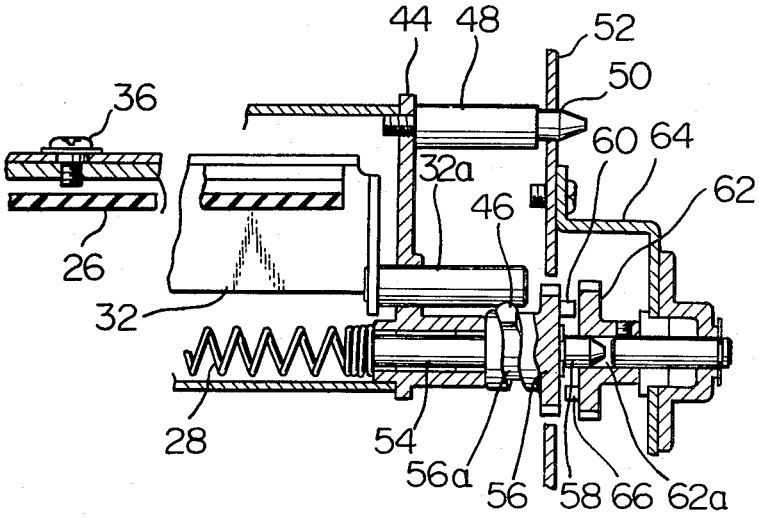

CLEANING APPARATUS FOR PHOTOCONDUCTIVE ELEMENT

BACKGROUND OF THE INVENTION

The present invention relates to cleaning apparatuses associated with electrophotographic copying machines, electrostatic recording machines or the like to remove residual toner particles from photoconductive elements with their cleaning members and, more particularly, to an arrangement installed in such a cleaning apparatus for facilitating ingress and egress of a casing which is equipped with cleaning members.

In an electrophotographic copying machine, for example, a photoconductive drum carries residual toner particles thereon even after the transfer of a toner image onto a sheet of paper. A predominant system heretofore employed for the removal of the residual toner uses a fur brush, a cleaning blade, a cleaning roller and/or like cleaning member and maintains them in pressing contact with the surface of the photoconductive drum. The cleaning members undergo progressive wear due to their pressing contact with the drum surface and, therefore, they have to be replaced with new ones periodically. Naturally, a part of the cleaning apparatus is frequently taken out for maintenance and other purposes as well. Should the cleaning members and their associated members be kept in contact with the drum surface while any part of the cleaning apparatus is removed, they would scratch the drum surface.

Thus, it has been customary to once move all the cleaning members and their associated members engaged with the drum surface clear of the latter and, then, pull out the whole cleaning apparatus or a part thereof. This, however, requires an additional provision for spacing the whole or a part of the cleaning apparatus from the photoconductive drum. Moreover, such a system is complex and costly.

SUMMARY OF THE INVENTION

In accordance with the present invention, a cleaning apparatus for a photoconductive element includes a cleaning member engaged with the surface of the photoconductive element to remove residual toner therefrom, a toner collecting member for collecting the toner removed from the cleaning member, and a casing for accommodating such members thereinside. The casing is formed with a guide section which permits the cleaning apparatus to be bodily moved in a direction perpendicular to an intended direction of movement of the photoconductive element. The guide section is positioned above the center of gravity position of the casing and farther from the photoconductive element than the center of gravity position. With this arrangement, the casing can be loaded and unloaded without any damage to the photoconductive element.

It is an object of the present invention to provide a simple and economical arrangement which eliminates the drawbacks discussed above and facilitates smooth movements of a cleaning apparatus without damage to a photoconductive element.

It is another object of the present invention to provide a generally improved cleaning apparatus for a photoconductive element.

Other objects, together with the foregoing, are attained in the embodiment described in the following description and illustrated in the accompanying drawings.

BRIEF DESCRIPTION OF THE DRAWINGS

FIG. 1 is a section of a cleaning apparatus embodying the present invention; and FIG. 2 is a sectional front view of the cleaning apparatus shown in FIG. 1.

DESCRIPTION OF THE PREFERRED EMBODIMENT

While the cleaning apparatus for a photoconductive element of the present invention is susceptible of numerous physical embodiments, depending upon the environment and requirements of use, a substantial number of the herein shown and described embodiment have been made, tested and used, and all have performed in an eminently satisfactory manner.

Referring to FIG. 1 of the drawings, the cleaning apparatus is generally designated by the reference numeral 10 and located in the vicinity of a photoconductive element 12 in the form of a drum. The drum 12 is driven for clockwise rotation as indicated by an arrow in the drawing. While various materials such as an organic photoconductor are usable for the drum 12, use is made of celenium in this embodiment by way of example. A latent image is formed electrostatically on the drum 12 by imaging means (not shown). The latent image is then developed into a toner image by a developer which contains a toner. The toner image is transferred electrostatically onto a sheet of paper which is fed from a sheet feeding apparatus (not shown) to a transfer station. The transfer station is defined by a transfer charger 14 for corona discharge. A charger 16 also for corona discharge neighbors the transfer charger 14 and has an opening directed toward a conveyor belt 18 to deposite electrostatic charge on the belt 18. The belt 18 is formed of an insulating material. The upper surface **16*a* of the charger 16 serves as a guide for a sheet of paper which is progressively separated from the surface of the drum 12. The paper sheet is guided by the guide surface 16*a* onto the conveyor belt 18 which has been charged to a predetermined polarity. Then, the conveyor belt 18** transfers the paper sheet to a fixing station (not shown) surely holding it on its surface.

Now, after the transfer of a toner image, any residual part of the toner or developer on the surface of the drum 12 must be positively removed before the next latent image is formed on the drum 12. The cleaning apparatus 10 is located for this purpose in a position downstream of the transfer station with respect to the direction of rotation of the drum 12. As shown, the cleaning apparatus 10 comprises a casing 20 movable relative to a casing 22 which is securely mounted on the body of the apparatus. The movable casing 20 carries therewith a fur brush 24, a cleaning blade 26 and a discharge coil 28. The fur brush 24 is rotated clockwise as indicated by an arrow so as to remove the residual toner from the drum 12. A lug 30 extends from the inner wall of the casing 20 so that the bristles of the fur brush 24 successively hit against the lug 30 to release the toner. The cleaning blade 26 is located to the downstream of the fur brush 24 with respect to the direction of rotation of the drum 12 and is made of an elastic composition such as polyurethane rubber. The cleaning blade 26 is fixed at its one end to a blade holder 32 through a support member 34. The other or free end of the cleaning blade 26 is held in pressing contact with the surface of the drum 12. The blade holder 32 and support 34 are fastened together by a stepped screw 36 substantially at a lengthwise intermediate portion of the cleaning blade 26. When the blade holder 32 is moved about its shaft 32*a* until the cleaning blade 26 becomes pressingly engaged with the drum 12, the cleaning blade 26 is permitted to automatically move about the stepped screw 36 into even contact with the drum surface over its entire length. It will be seen that the closer the position of the stepped screw 36 to the drum surface is, the more even the contact of the cleaning blade 26 with the drum surface becomes.

A guide section generally designated by the reference numeral 38 is formed in an upper portion of the cleaning apparatus 10. The guide section 38 is located above the center of gravity position of the movable casing (indicated by G in the drawing) and farther from the drum 12 than the center of gravity position. The guide section 38 is constituted by a channel 40 formed in the fixed casing 22 and a hook 42 formed in the movable casing 20. The hook 42 is engaged in the channel 40 and serves to guide the movement of the casing 20 out of the cleaning apparatus perpendicularly to the plane of the sheet. The whole movable casing 20 is suspended from the fixed casing 22 along its hook 42.

Referring to FIG. 2, the movable casing 20 has a side plate 44 by which the shaft 32*a* of the blade holder 32 is movably supported. A pin 46 is studded in a part of the shaft 32*a*. A transverse positioning pin 48 extends from an upper portion of the side plate 44 and has its outermost end engaged in a hole 50 which is formed through a side plate 52 of the apparatus body. The discharge coil 28 is rigidly mounted on a transverse shaft 54 which is journalled to the side plate 44 of the casing 20. A gear 56 is rigid on the shaft 54 while a positioning pin 58 extends from the end of the shaft 54. The gear 56 carries a stub 60 on its one end and has a boss which is formed with a contoured cam groove 56*a*. The pin 46 on the blade holder shaft 32*a* is received in the cam groove 56*a*. A gear 62 is rotatably mounted to a support plate 64 which is in turn mounted on the side plate 52. The gear 62 is formed with a bore 62*a* in its central area so as to receive the pin 58 therein. A stub 66 is studded on the gear 62 to be engagable with the stub 60 on the opposite gear 56. The gear 62 is driven for rotation by drive means (not shown) so that the gear 56 is also driven when the stub 66 is engaged with the stub 60. The gear 56 in rotation causes the discharge coil 28 to rotate through the shaft 54. The contoured cam groove 56*a* cams the pin 46 in response to the rotation of the gear 56, thereby driving the shaft 32*a* into oscillation to the left and right as viewed in FIG. 2. The cleaning blade 26, therefore, reciprocates in the axial direction of the drum 1. The gear 56 is meshed with a gear (not shown) which is associated with the fur brush 24 shown in FIG. 1.

During a cleaning operation, the gear 62 is driven for rotation to in turn rotate the fur brush 24 and discharge coil 28. The cleaning blade 26 fully removes the toner which the fur brush 24 has failed to clear. The toner thus let fall by the blade 26 is driven out of the cleaning apparatus 10 by the rotating discharge coil 28.

As shown in FIG. 1, a sealing member 68 is attached to the lower leading edge of the movable casing 20 and held in light contact with the surface of the drum 1. The sealing member 68 prevents scattered particles of the toner from leaking to the outside through the gap defined between the casing 20 and the drum 12.

For the maintenance of the cleaning apparatus or the replacement of various cleaning members, one pulls the movable casing 20 out of the apparatus perpendicular to the plane of the sheet in FIG. 1 or to the left in FIG. 2. As shown in FIG. 2, the casing 20 positioned inside the cleaning apparatus is engaged with the rigid frame members at its positioning pins 48 and 58. As the casing 20 is pulled out a predetermined distance, the pins 48 and 58 become individually disengaged from the frame members to make the casing 20 supported by the fixed casing 22 at the guide section 38 only, as shown in FIG. 1. In this situation, since the guide section 38 is located farther from the drum 12 than the center of gravity position G of the movable casing 20, the casing 20 is rendered rotatable about the guide section 38 in the clockwise direction, that is, away from the drum 12. As a result, the fur brush 24, cleaning blade 26 and seal member 68 become clear of the surface of the drum 12 as the casing 20 is progressively pulled out of the machine. When pulled farther outwardly, the casing 20 becomes guided by the channel 40 of the fixed casing 22 and can be entirely taken out from the machine. To mount the movable casing into the machine, on the other hand, one pushes the casing 20 into the cleaning apparatus with its hook 38 engaged in the channel 40 of the fixed casing 22. The casing 20 in a final part of this movement is rotated counterclockwise until the pins 48 and 58 are received in the hole 50 in the side plate 52 and the bore 62*a* in the gear 62, respectively. This locks the casing 20 in the predetermined operative position inside the apparatus.

In summary, it will be seen that the present invention provides a cleaning apparatus which allows its casing to be pulled out smoothly without any damage to the surface of a latent image carrier element. This is realized by the inherent position of a casing guide section which is above the center of gravity position of the casing and farther from the photoconductive element than the center of gravity position. It will also be seen that the apparatus of the invention is simple and incostly because it eliminates the need for additional implements for moving cleaning members clear of the conductive element.

Various modifications will become possible for those skilled in the art after receiving the teachings of the present disclosure without departing from the scope thereof.

What is claimed is:

1. A cleaning apparatus for a photoconductive element, comprising:

cleaning means for removing toner particles remaining on the photoconductive element in contact therewith;

toner collecting means for collecting the toner particles removed by the cleaning means;

a casing accommodating the cleaning means and toner collecting means thereinside and movable in a direction perpendicular to an intended direction of movement of the photoconductive element; and guide means formed in the casing at a location which is above the center of gravity position of the casing and farther from the photoconductive element than the center of gravity position.

2. A cleaning apparatus as claimed in claim 1, in which the cleaning means comprises a fur brush and a cleaning blade which is supported by a blade holder.

3. A cleaning apparatus as claimed in claim 2, in which the blade holder is rotatably connected with a support member by a screw, said support member being pivotable about a predetermined axis toward the photoconductive element.

4. A cleaning apparatus as claimed in claim 1, in which the casing is made up of a fixed part and a movable part.

5. A cleaning apparatus as claimed in claim 4, in which the guide means comprises a channel formed in the fixed part of the casing and a hook formed in the movable part of the same, said hook being engaged in the channel so that the movable part is swingably and removably suspended from the fixed part.

6. A cleaning apparatus as claimed in claim 1, in which the toner collecting means comprises a discharge coil.

7. A cleaning apparatus as claimed in claim 1, further comprising a sealing member for preventing the collected toner particles from being scattered to the outside of the casing.

* * * * *